United States Patent [19]

Breckenridge

[11] 4,401,407

[45] Aug. 30, 1983

[54] GRASPING APPARATUS AND COLLECTION VEHICLE

[76] Inventor: David L. Breckenridge, P.O. Box 623, Monroe, Iowa 50170

[21] Appl. No.: 94,075

[22] Filed: Nov. 14, 1979

[51] Int. Cl.[3] ..... B65F 3/06

[52] U.S. Cl. ..... 414/408; 294/88; 294/106; 414/420; 414/733

[58] Field of Search ..... 414/406, 408, 547, 549, 414/555, 700, 733, 420; 294/88, 106; 212/269

[56] References Cited

U.S. PATENT DOCUMENTS

| | | | |
|---|---|---|---|
| 3,165,348 | 1/1965 | Keskitalo | 294/88 |
| 3,516,553 | 6/1970 | Reske | 212/269 |
| 3,620,561 | 11/1971 | Grotkasten | 294/88 X |
| 3,765,554 | 10/1973 | Morrison | 414/408 |
| 3,843,004 | 10/1974 | Kambe | 414/700 |

*Primary Examiner*—Robert G. Sheridan
*Attorney, Agent, or Firm*—James F. Hollander

[57] ABSTRACT

A grasping arm subassembly article has an inner arm pivoted to a frame with an outer arm pivoted between its ends to the inner arm. The outer arm is pivotally moved graspingly in response to pivotal movement of the inner arm by a linkage mechanism including serially pivoted first, middle, and second links. The second link is pivoted to the outer arm and the first link is pivoted to the frame. Advantageously, the middle link is pivoted to the inner arm at a point between its own ends and between the ends of the inner arm. A hydraulic cylinder is pivoted to the frame and to the arm subassembly for powering the arm.

A grasping device suitably uses two or more such arm subassemblies movable inwardly and outwardly about the frame. In a specific example of a refuse container collection function, the grasping is done by a collection vehicle. The device for grasping the containers comprises a telescopically extensible boom assembly adapted to be mounted to the chassis frame of the vehicle. The boom assembly can move telescopically outwardly from the vehicle and includes on its outer end two grasping arms for grasping containers of varying sizes and shapes. After grasping the container, the boom assembly pivots upwardly about a horizontal axis using a hydraulic system to automatically keep the container level, and empties the contents of the container into the storage portion of the vehicle.

18 Claims, 13 Drawing Figures

GRASPING APPARATUS AND COLLECTION VEHICLE

CROSS-REFERENCE TO RELATED APPLICATION

Reference is hereby made to the present inventor's previous United States of America patent application Ser. No. 06/071240, entitled CONTAINER GRASPING DEVICE of David L. Breckenridge, filed in the United States Patent and Trademark Office on Aug. 30, 1979, abandoned Mar. 18, 1980.

BACKGROUND OF THE INVENTION

This invention relates to the field of mechanical grasping devices and subassembly articles of manufacture used in constructing grasping devices. More specifically this invention relates to grasping devices and subassemblies having at least one multiply-segmented arm structure for grasping. The invention also relates to vehicular grasping devices.

In prior art grasping devices, such as the one schematically illustrated in FIG. 12, an inner arm 170 is pivoted to an outer arm 180. The outer arm 180 would swing uselessly on inner arm 170 but for a link 160 which enables the outer arm to help grasp an object 195 when a force 190 is applied.

Unfortunately, such prior art grasping devices must utilize the relatively long inner arm 170 and link 160 which are prone to bending and buckling with heavy loads precisely due to the long length. This problem rapidly increases in severity with increase in size and weight of the load because such load requires greater bending and buckling strength but perversely requires the larger arm and link lengths that reduce bending and buckling strength. Strengthening the prior art grasping devices with additional material, of course, increases their cost.

Inner arm 170 and link 160 of the prior art cross over each other, so that each is physically in the way of the other relative to an object 195 in the grasping region. Thus, an inherent limitation on the size of the object to be grasped is placed on the prior art device. In addition, the crossover complicates construction that further increases cost. When substantial extra material is added to the inner arm to permit an object to be grasped without bumping the link, the size and weight capacity of the grasping device is reduced.

Also, the crossover construction of the prior art can lead to mechanical rubbing and binding-up problems between inner arm and link under heavy loading transverse to the plane of the prior art device (perpendicular to plane of paper of FIG. 12). For this additional reason the crossover complicates construction and leads to mechanical strength limitations.

The background of the invention is further suggested by reference to a very specific field of vehicular collection application.

This invention relates to mobile refuse collecting devices, and particularly to a container grasping device adapted to be mounted on a vehicle for grasping, lifting, and emptying a refuse container into the storage portion of the vehicle.

The present methods and devices for collecting refuse are time consuming and labor consuming. Normally, a refuse collection vehicle drives through the community, and several laborers are required to lift the containers at each residence, and empty them into the storage portion of the vehicle.

Various attempts have been made to automate the grasping, lifting and emptying of the containers. However, several problems have been encountered with such devices. The containers in which the public store refuse often vary in size and shape, and therefore problems develop in designing apparatus which can readily grasp containers of varying sizes and shapes.

Often the containers are placed in positions difficult to reach with mechanical apparatus. For example, they may be resting upon a curb, in a snow bank, or on a level which is difficult to reach with apparatus attached to the vehicle.

Another problem is the difficulty in positioning the vehicle the proper distance from the container. It is desirable to have apparatus which can compensate for different distances between the vehicle and the container so that the vehicle driver does not need to worry about positioning the vehicle at the exact proper distance from the container.

SUMMARY OF THE INVENTION

According to the present invention a grasping device is provided having a frame and a plurality of arm members connected to the frame. At least one of the arm members has an inner arm member pivoted to the frame with an outer arm member pivoted between its ends to the inner arm. The outer arm is controllably moved relative to the inner arm so as to accomplish a grasping motion by means of a linkage including serially pivoted first, middle, and second links. The linkage has the second link pivoted to the outer arm, and the first link is pivoted to the frame at a point offset from the inner arm frame pivot. Advantageously the middle link is pivotally connected intermediately along its own length to the inner arm intermediately along the length of the inner arm. An extensible power unit, such as an hydraulic cylinder, is pivotally connected to the arm member just described and pivotally based on the grasping device for moving the arm just described relative to the other arm members opposably in a grasping function.

The arm member just described having the inner arm, outer arm, and linkage is conveniently manufactured as an inventive subcombination which can later be united with arms of the same or different construction to form the inventive grasping device combination.

The use of the linkage including the first, middle, and second links is responsible for a number of the advantages of the invention compared to the prior art. In a first advantageous feature the grasping strength or grip of the device is considerably augmented compared to the prior art because the single link of the prior art is replaced with the linkage which is broken up into at least the three links.

The greatest stress on an arm member occurs when it is forcibly grasping, gripping, or bearing inwardly or compressively on the object to be grasped. The tendency toward bending sideways or buckling in compression in the long prior art link in the maximum stress condition is substantially reduced by replacement with the linkage because it is remarkably observed that the first link is under tension and cannot bend or buckle. The second link, which is under compression, is advantageously short in length and consequently has much less tendency to buckle or bend with the same cross-section than does a prior art control arm. The middle link, being even shorter, has still more resistance to bending or buckling. Thus, this novel linkage construction including the mounting of the middle link intermediate on the inner arm synergistically strengthens the arm. This advantage also means that the arm including the linkage can be lighter in overall construction and consequently less expensive than prior art units for use in grasping the same loads.

In a second advantageous feature the linkage is capable of being located entirely outward relative to the inner and outer arm members (away from the object or load to be grasped) as when material of the inner arm, or a spacing member, is used to space the middle link pivot away from the inward grasping surface of the inner arm. The linkage is also located outward relative to an imaginary straight line between the pivoting ends of the inner arm member, thus overcoming the apparently inherent crossover disadvantage of the link in the prior art devices. Then, unlike the prior art units with the link which must be pivotally based on the frame inward relative to the load compared to the inner arm base pivot to obtain the control function for the outer arm, the inventive linkage is entirely removed from the region where grasping of the object is to occur.

Consequently, a grasping device can be constructed according to the invention where the object to be grasped can be held on the inner arm and inside the grasping device much closer to the frame. The practical significance of such construction is that the load held can be heavier and physically larger for the same size and weight of grasping or that the same load can be held with lighter, smaller grasping device construction, hence less expensive construction of grasping arms, hydraulic cylinders, frame-carrying boom, and so forth.

In a third advantageous feature of the invention, the extensible power unit is very flexible in its location, and in some embodiments is advantageously pivoted to the frame at one end and to the middle of the inner arm at the other end. This means that the inner arm which carries a substantial loading force from the object to be grasped is synergistically reinforced by the doubly triangular strength of (A) the middle link, first link, and extensible power unit acting together, and (B) the frame, inner arm, and extensible power unit, and thus the inner arm can be of lighter, less expensive construction for the same loads.

In a fourth advantageous feature of the invention the motion of the middle link of the linkage can occur near or within the inner arm, when the inner arm is made of channel construction for increased strength of the inner arm. A physically compact construction is obtained, and a channel rather than a heavier, solid inner arm cross-section suffices to provide fully adequate strength for grasping and holding loads which provide loading forces perpendicular to the plane of the arm, as during a container lifting operation.

The arm member subassembly of the invention can be combined symmetrically opposite a second arm member subassembly of the invention on a frame to form a light, inexpensive, and advantageous grasping device of the invention. Likewise, a third or even more additional arm member subsassemblies in more than one plane can be mounted on a frame to form a single grasping device for grasping an object from several directions. In other forms the arms are provided to form a plurality of grasping devices to grasp one or more objects serially or simultaneously at different locations along a frame or boom. In still other forms of the inventive grasping device one or more arm subassemblies of the invention are combined with one or more movable or immovable arm subassemblies of distinct construction. Also, the arm member subassembly of the invention can form a part of a more complex arm member subassembly having more digits (as in a finger) than just the inner and outer arm.

The grasping device of the invention offers these and many other advantages for providing a very secure and positive "wrap-around" grasping function for objects of many shapes and sizes economically, swiftly, and reliably. It can grasp objects or containers of material. As such, it commends itself for use in all outdoor and indoor industries wherein grasping, lifting, transferring, handling, dumping, loading, closing, opening, twisting, and the like are to be performed. It makes possible secure grasping under remote control as can be required in the radioactive materials handling industry, as well as augmentation of the strength of a nearby operator as in the construction field.

The utility of the invention is further discussed in connection with a specific example from the solid wastes management field in grasping, lifting, and dumping refuse containers into vehicles.

The present invention utilizes a telescopic boom assembly which is mounted to the chassis frame of the vehicle and which is pivoted about a horizontal axis to that it may swing from a substantially horizontal or slightly downwardly inclined position to an upstanding position alongside the storage bin of the vehicle. The telescopic arm is capable of extending outwardly toward a container and includes a grasping means on its outer end. The grasping means includes diverging arms which move inwardly and outwardly in pincer like fashion to accommodate the varying sizes and shapes of containers. The arms grasp the container, and the telescopic boom is pivoted from a substantially horizontal position to its upstanding postition. The grasping means is then pivoted about a horizontal axis so that the container is inverted over the storage bin of the vehicle and the contents of the container are emptied into the storage bin.

In order to prevent the container from spilling prior to the time that it is placed over the storage bin, a leveling means is provided so that the grasping means holds the container in a substantially upright position throughout the movement of the telescopic arm from its horizontal postition to its vertical position. This accomplished by a slave hydraulic cylinder responsive to the pivotal swinging movement of the boom assembly. The slave cylinder is connected to the hydraulic cylinder for tilting the grasping means, and causes the grasping means to hold the container in a substantially upright position throughout its swinging movement. Then when it is desired to turn the container upside down, the hydraulic cylinder for moving the grasping means is actuated and the grasping means tilts the container upside down.

The operation is completed by tilting the container back out of the bin, lowering the container and returning it to rest, and retracting the telescopic arm. Since the telescopic arm is side-mounted beneath the bin to the vehicle chassis and the grasping means can lastly be tilted vertically, the entire assembly folds into a compact position at the side of the vehicle during self-locomotion of the vehicle and does not protrude substantially beyond the lateral sides of the vehicle when in its folded compact position.

DETAILED DESCRIPTION OF THE INVENTION

Figure 1:
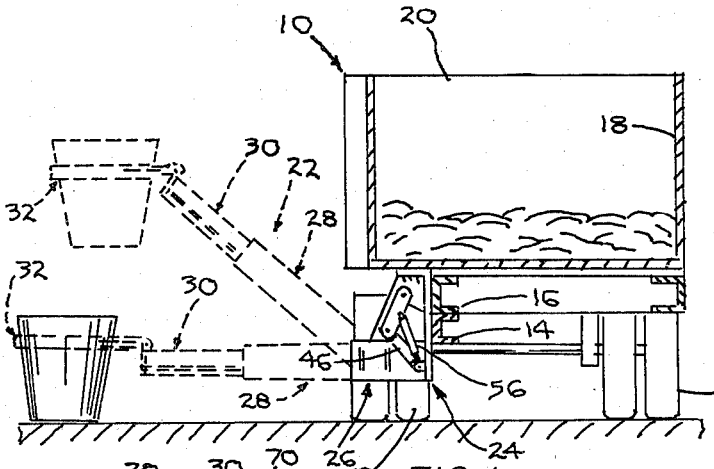
FIG. 1 is a rear elevational view of a vehicle having the container grasping device of the present invention thereon.

Referring to the drawings, the numeral 10 generally designates a refuse collection vehicle having a set of supporting wheels 12, a pair of elongated channel frame members 14, 16 and a trash storage bin 18 having an opening 20 at its upper end for inserting the trash or refuse.

Mounted to frame members 14, 16 is a container grasping assembly comprising a base frame 24, an inner boom 26, a middle boom 28, an outer boom 30 and a grasping device 32.

Base frame 24 includes rectangular frame members 34, 36, 38 adapted to be bolted or otherwise securely fastened to channel frame members 14, 16 of vehicle 10. Extending outwardly from the upper portion of base frame 24 are a pair of hinge flanges 40 which rotatably support a first hinge shaft 42.

Inner boom 26 includes a pair of triangular flanges 44 which are fixed to shaft 42 for rotation therewith so as to create hinged mounting to hinge flanges 40 of base frame 24. A pair of hydraulic tilt cylinders 46 are pivotally mounted at 48 to one end of a crank arm 50 and are pivotally mounted at their opposite ends to a shaft 52 extending through a pair of ears 54 mounted to the bottom of base frame 24. Crank arm 50 is fixed to the end of hinged shaft 42 as are triangular flanges 44 of inner boom 26. Thus, extension of tilt cylinder 46 causes crank arm 50, hinge shaft 42, and triangular flanges 44 to pivot about the axis provided by the pivotal movement of shaft 42 in hinge flanges 40.

A slave cylinder 56 is pivotally mounted at its lower end to shaft 52, and is pivotally mounted at its upper end to crank arm 50 at a point 58 intermediate hinge shaft 42 and pivotal axis 48. Slave cylinder 56 is adapted to be extended and retracted by pivotal movement of crank arm 50 in response to actuation of tilt cylinder 46. Slave cylinder 56 is connected into the hydraulic circuit for controlling the leveling of grasping device 32 as more fully described hereinafter.

Figure 3:
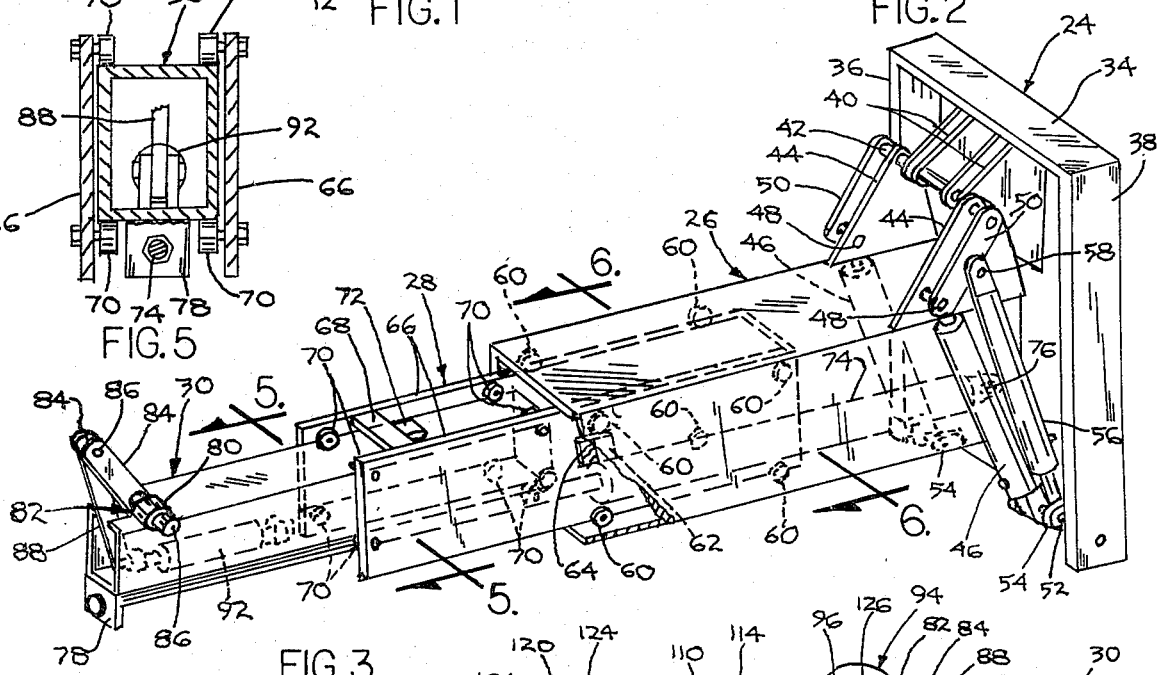
FIG. 3 is a perspective view of the telescoping boom assembly of the container grasping device.
Figure 6:
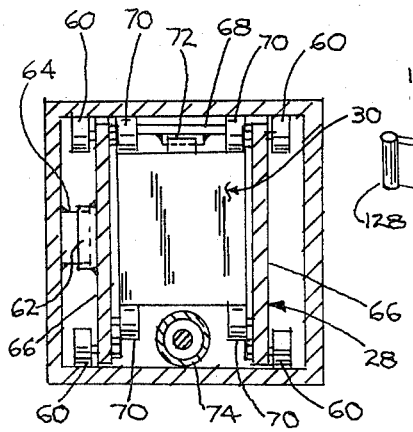
FIG. 6 is a sectional view taken along line 6—6 of FIG. 3.
Figure 4:
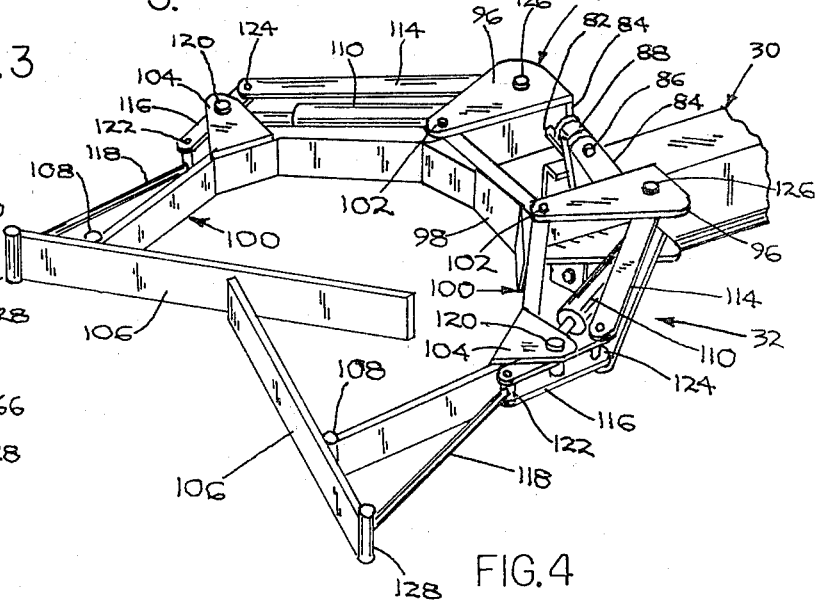
FIG. 4 is a perspective view of the grasping means at the outer end of the device.
Figure 7:
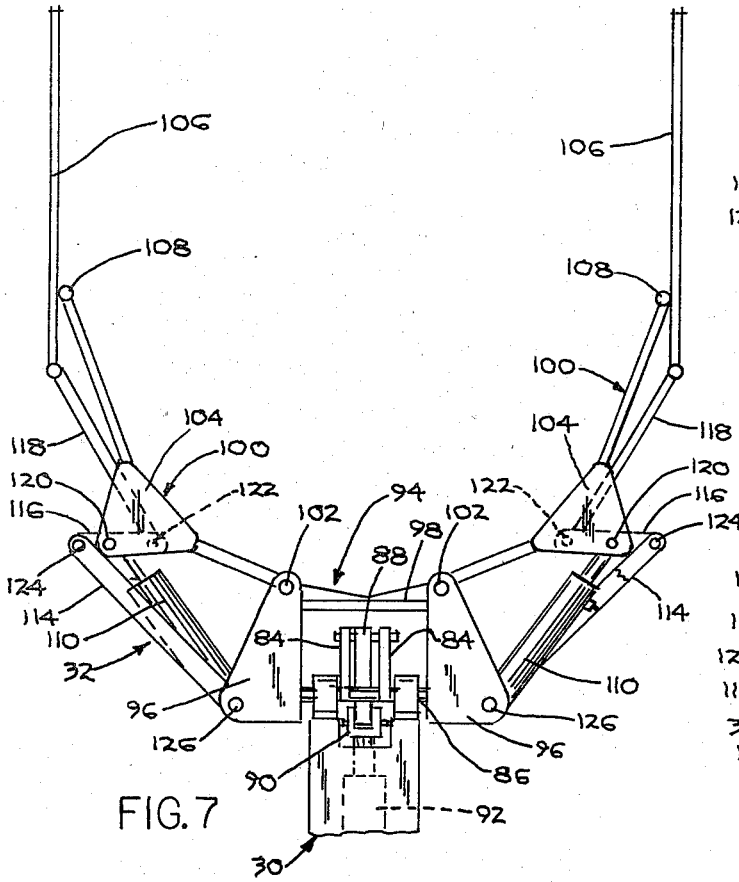
FIG. 7 is a top elevational view of the grasping means on the outer end of the present invention.

Middle boom 28 is slidably received within inner boom 26 and includes on its outer surface a set of wheel bearings 60 which engage the interior surface of inner boom 26 so as to provide smooth rolling extension of middle boom 28 from within inner boom 26. Mounted on the outer surface of middle boom 28 is a first stop 62, and mounted on the interior surface of inner boom 26 is a complementary stop 64. These two stops 62, 64 engage one another whenever middle boom 28 has extended to the position shown in FIG. 3, and the engagement of stop 62, 64 limits the outward extension of middle boom 28 beyond that point.

Middle boom 28 is comprised of a pair of spaced apart side members 66 interconnected and held in spaced apart relationship by cross member 68 and other cross members (not shown). A plurality of wheel bearings 70 are mounted on the interior facing surfaces of side members 66 and are adapted to roll on the outer surface of outer boom 30 so as to provide smooth rolling extension of outer boom 30 with respect to middle boom 28. A stop 72 is mounted on the upper surface of inner boom 30 and is adapted to engage cross member 68 of middle boom 28 whenever the inner boom 30 extends to the position shown in FIG. 3. This limits outward extension of inner boom 30 beyond a predetermined point.

Figure 11:
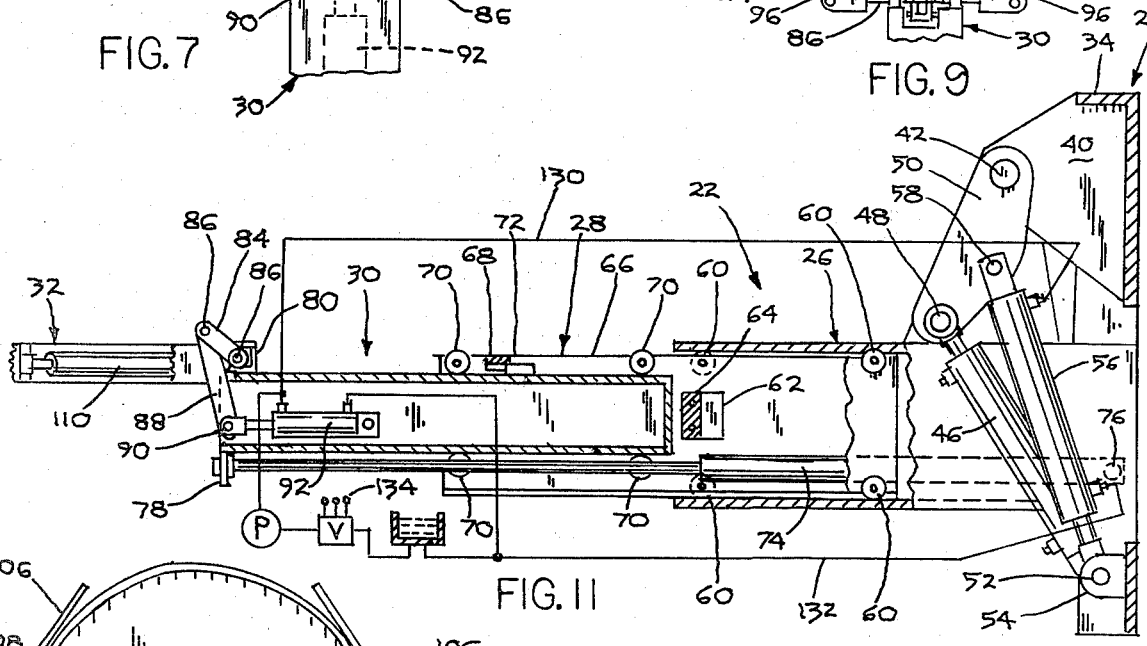
FIG. 11 is a sectional view of the boom assembly showing the interior of the various booms.

Referring to FIG. 11, an extension cylinder 74 is mounted within inner boom 26 and middle boom 28 and includes one end secured at 76 to base frame 24. The opposite end of extension cylinder 74 is connected to a downwardly extending flange 78 at the extreme outer end of outer boom 30 so that extension and retraction of cylinder 74 causes extension and retraction of booms 28, 30 with respect to inner boom 26.

The extreme outer end of outer boom 30 is provided with a pair of spaced apart ears 80 adapted to rotatably receive an elongated shaft 82 therein. A pair of crank arms 84 are welded or otherwise fixed to shaft 82 between ears 80, and the distal ends of crank arms 84 are joined by a shaft 86. Pivotally mounted on shaft 86 between the distal ends of crank arms 84 is a link 88 which extends downwardly therefrom and which is pivoted at its lower end to a clevis 90 at one end of a cylinder 92 mounted within the outer end of outer boom 30. Extensible movement of cylinder 92 is transmitted through link 88 to crank arms 84, thereby causing rotation of shaft 86 about a horizontal axis.

The outer ends of shaft 86 are fixed to and form a part of a central frame 94 which comprises a pair of triangular side gussets 96 and a cross frame member 98.

A pair of inner arm members 100 are slightly bent in shape and are connected at their inner ends to central frame 94 for pivotal movement about a pair of inner axes 102. Inner arms 100 include triangular gussets 104 located intermediate their lengths. Pivotally connected to the outer ends of inner arm members 100 are a pair of outer arm members 106 which are adapted to be pivoted about axis 108. Axes 108 are at the extreme outer ends of inner arm members 100, but are spaced inwardly intermediate the opposite ends of outer arm members 106.

Pivotal movement of inner arm members 100 is controlled by a pair of grasping cylinders 110 which are pivoted between triangular side gussets 96 of central frame 94 and triangular gussets 104 of inner arm members 100. Extension and retraction of cylinders 110 causes pivotal movement of inner arm members 100 about axis 102.

The pivotal movement of outer arm members 106 is controlled by a linkage assembly comprising a first link 114, a middle link 116, and a second link 118. Middle link 116 is pivoted at its approximate center to triangular gusset plate 104 for pivotal movement about a central axis 120. One end of middle link 116 is pivoted to second link 118 at 122 and the other end of middle link 116 is pivoted to first link 114 at 124. The opposite end of first link 114 is pivoted at 126 to triangular side gussets 96 of central frame 94. The opposite of second link 118 is pivoted at 128 to the inner end of the outer arm 106.

The resulting structure of links 114, 116 and 118 causes outer arms 106 to pivot in response to pivotal movement of inner arms 100 about axis 102.

Figure 8:
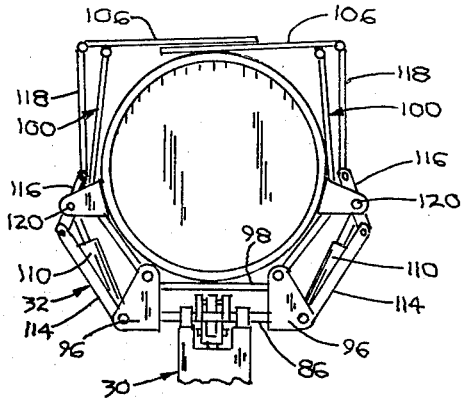
FIGS. 8, 9 and 10 are views similar to FIG. 7, but showing the grasping means engaging and grasping containers of varying sizes and shapes.
Figure 9:
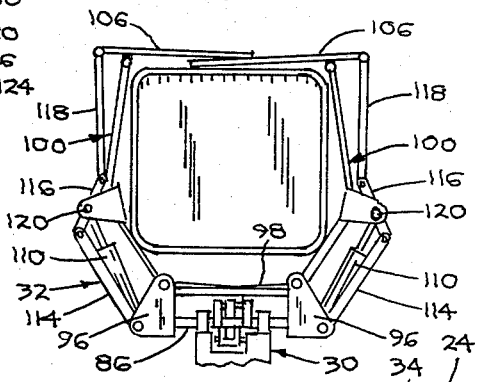
Figure 10:
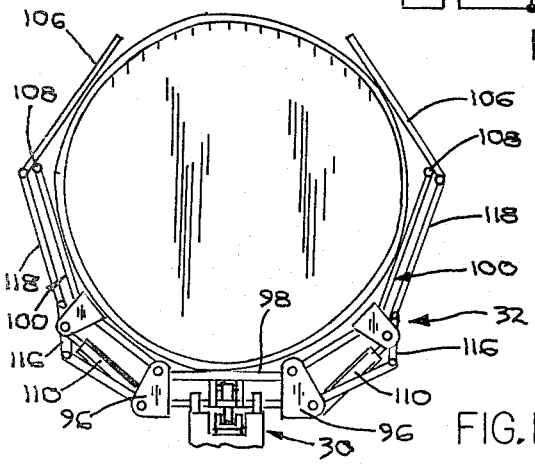

FIGS. 8, 9 and 10 illustrate the manner in which arms 100, 106 fold about containers of varying shapes and sizes. In FIG. 8, a small circular container is shown, in FIG. 9, a rectangular container is shown, and in FIG. 10, a large circular container is shown. The arms fold to fit against all of these containers of varying shapes and sizes. It is emphasized that pivots 108 and 128 keep the distance 108,128 between them constant in FIGS. 4,7,8,9, and 10 and the arms grasp around containers of varying shapes and sizes with structurally triangular controllability by action of hydraulic cylinders 110.

Referring to FIG. 11, the hydraulic leveling apparatus for maintaining level orientation of grasping device 32 is shown. Leveling cylinder 56 includes a hydraulic connection 130 leading to cylinder 92. The other end of slave cylinder 56 includes a connection 132 leading to the other end of cylinder 92. Whenever inner boom 26 pivots upwardly about its pivotal axis 42, cylinder 56 is extended, thereby forcing hydraulic fluid into cylinder 92 and causing retraction of cylinder 92. The movement of inner boom 26 from its upstanding position towards its horizontal position causes fluid to be forced into cylinder 92 to cause extension of cylinder 92. The respective diameters and volumes of cylinders 56, 92 are chosen so that grasping device 32 is maintained in a relatively horizontal orientation throughout movement of the boom assembly from its lowered position shown in FIG. 1 to its upstanding position shown in FIG. 2.

Figure 2:
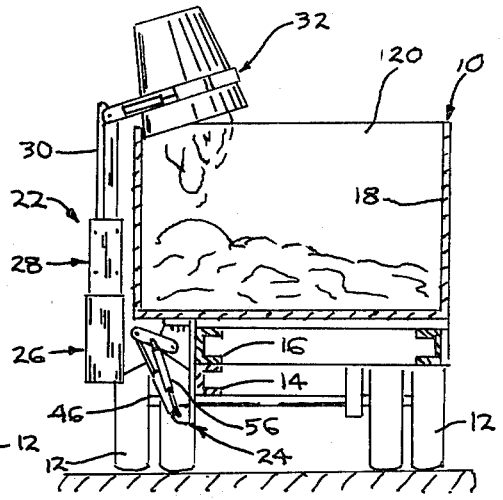
FIG. 2 is a view similar to FIG. 1 showing the container grasping device in its upstanding position.
Figure 5:
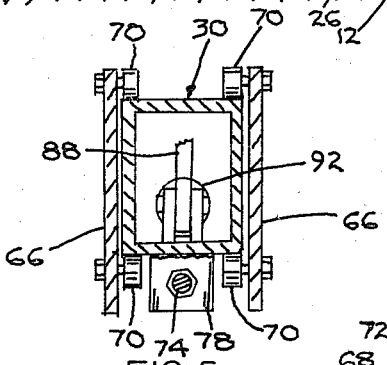
FIG. 5 is a sectional view taken along line 5—5 of FIG. 3.

When it is desired to empty the contents of the container into the vehicle, the operator merely actuates a control lever 134 (FIG. 11), which is located within the cab of the vehicle, and this control lever introduces hydraulic fluid to cylinder 92 for causing the inversion of the container to permit the contents to fall outwardly therefrom as shown in FIG. 2. The remaining controls for the other hydraulic components are contained within the vehicle cab and are not shown in the drawings.

The boom assembly is pivotal from a lowered position shown in FIG. 1 to an upstanding position shown in FIG. 2. In its lowered position, the boom assembly can extend slightly downwardly so as to accommodate containers which are on a level lower than the level of the vehicle. The grasping device of the present invention is capable of grasping containers of varying sizes and shapes as shown in FIGS. 8–10. The device can reach downwardly and outwardly to grasp a container and the leveling means previously described maintains a container in an upright position until it is ready to be emptied into the vehicle. The entire operation may be accomplished by the operator sitting within the vehicle cab and manipulating the controls for the grasping device. Thus, it can be seen that the device accomplishes at least all of its stated objectives.

Figures 12, 13:
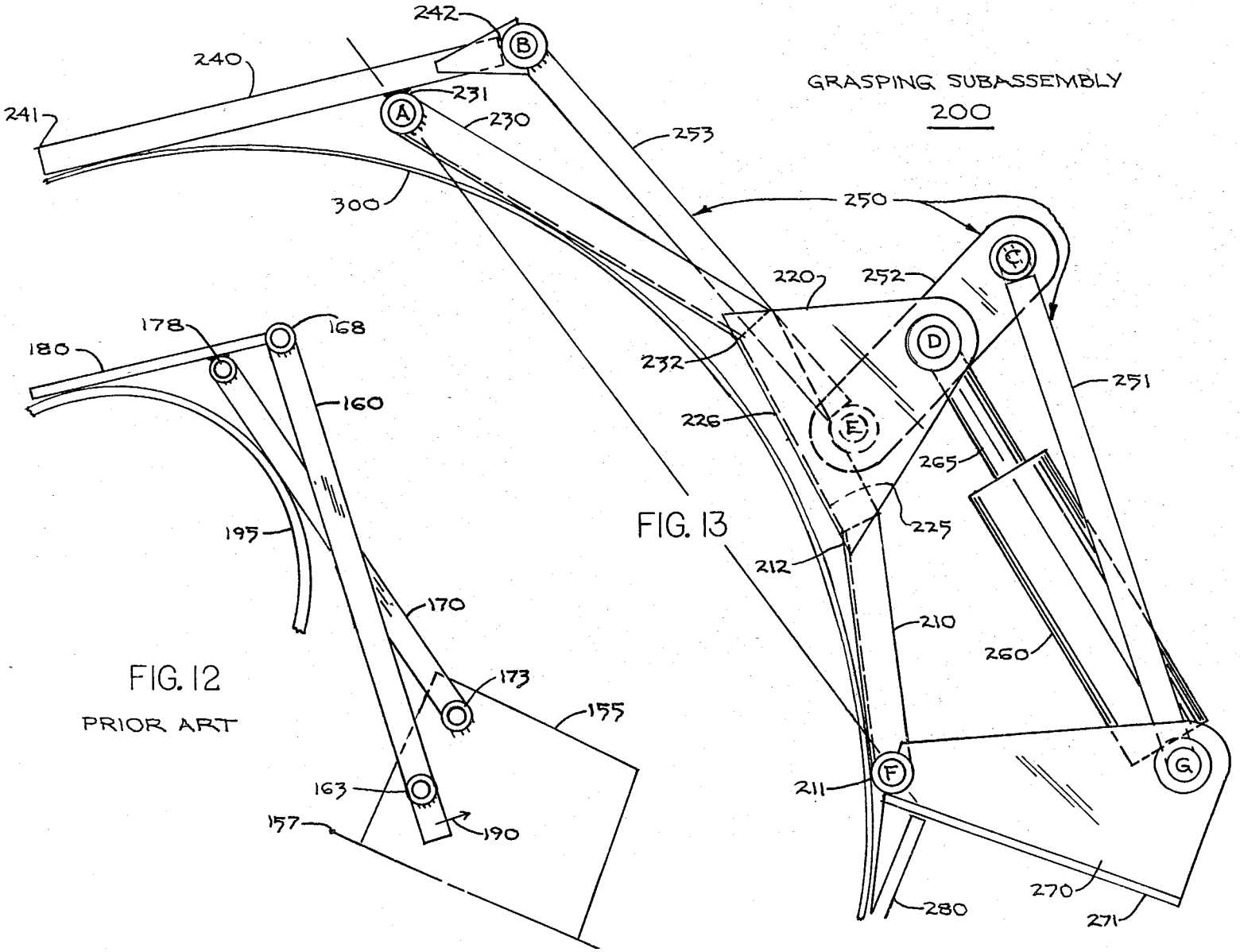
FIG. 12 PRIOR ART
FIG. 12 is a top elevational schematic view of a grasping arm of the prior art provided for comparison.
FIG. 13 is a top elevational view of a grasping arm subassembly of the present invention for detailed analysis.

FIG. 13 is a drawing of the details of the grasping arm subassembly 200 of the preferred embodiment, shown substantially to scale. Grasping subassembly 200 is comprised of triangular frame plate 270; an inner arm 210,220,230; outer arm 240; and linkage 250. The inner arm is pivoted at its first end 211 to pivot F. The outer arm, which has outer end 241 and inner end 242, is pivoted intermediate ends 241 and 242 to inner arm second end 231 at pivot A. Linkage 250 is comprised of first link 251, middle link 252, and second link 253. Each link has a first and second end. The first end of link 251 is pivoted at pivot G. The second end of link 251 is pivoted at pivot C to the first end of middle link 252. The second end of middle link 252 is pivoted at pivot E to the first end of link 253. The second end of link 253 is pivoted at pivot B to inner end 242 of outer arm 240. The middle link 252 is pivoted at pivot D, which is at a point intermediate ends 211 and 231 of inner arm 210,220,230. Also, pivot D is at a point intermediate the first end C and second end E of middle link 252.

FIG. 13 is substantially drawn to scale compared to the preferred embodiment of the inventive subassembly used in the grasping device which was successfully constructed and tested. The lengths of inner arm segments 210,220,230 are substantially in the ratio 8.2:7.0:14.2. The outer arm 240 length from inner end 242 to outer end 241, the pivot A to pivot B length, and the inner arm segment 230 length are substantially in the ratio 16:5:14.2. The inner arm segment 220 length from 212 to 232, the distance from grasping surface 226 to center of pivot D, the length GC of first link 251, the length CE of middle link 252, and the length EB of second link 253 are substantially in the ratio 7:6:18.5:8:17.5. Pivot D is halfway between pivots C and E. Inner arm segment length 211 to 212, pivot F center distance from frame plate reference surface 271, pivot G center distance from frame plate reference surface 271, and center-to-center distance of pivot F to pivot G are substantially in the ratio 8.2:1.375:4.25:10. The preferred embodiment shown in FIG. 13 has a capacity for grasping objects with approximate circular diameters in ratio to each other and to outer arm 240 length of 22:42:16 respectively. Thus, where all the untis are inches, the device can grasp objects of diameters from 22 to 42 inches.

when the subassembly 200 is used as part of a grasping device to hold object 300, outer arm 240 experiences a substantial force directed outward relative to object 300. In a statics force analysis setting torque around pivot A equal to zero, the force along second link 253 must be toward pivot B, meaning that second link 253 is in compression. Consequently, there is also a second link 253 force toward pivot E. Setting torque around pivot D equal to zero, the force along first link 251 must be away from pivot C, meaning that first link 251 is under tension. Setting the summation of vector forces at pivot A equal to zero, the force along inner arm segment 230 must be away from pivot A meaning that the segment 230 is under tension there. Thus, an efficient distribution of stresses around the subassembly 200 is set up.

The inventive subassembly of FIG. 13 compares favorably with the prior art mechanism of FIG. 12. In FIG. 12 link 160 is in compression over its entire long length, which leads to low bending and buckling strength compared to the much shorter link 253 in FIG. 13. In FIG. 12, in order to graspingly control outer arm 180 the link 160 is required to cross over inner arm 170 to the region inward of inner arm 170 so that the link pivot 163 is closer to central axis 157 than inner arm frame pivot 173. Thus, it is apparently inherent in the prior art of FIG. 12 that some part of link 160 is inward of a straight line joining the ends of inner arm 170 at pivots 173 and 178, complicating the construction of the prior art device as a practical matter, and reducing its grip and size of grasping capacity.

In advantageous contrast, the inventive subassembly of FIG. 13 has the entire linkage 250 composed of links 251, 252, and 253 located entirely outward of an imaginary line, straight line AF, joining the ends of inner arm 210,220,230 pivoted at pivots A and F. Moreover, the approximately arcuate inner grasping surface 226 of the inner arm has the linkage 250 entirely outward of that surface 226 as well and separated away from the object 300 at all points. Accordingly, the size of grasping capacity is used to the fullest extent in the inventive subassembly 200. This advantage is in part due to the use of the material of the triangular channel gusset spacing member 220 as part of the inner arm to space the middle link at pivot D away from the grasping surface 226. Then the second end of middle link 252 at pivot E easily clears the inside surface 225 of the channel shaped spacing triangle 220 during rotation of middle link 252.

Advantageously, the inner arm is made of channel construction all along its length from pivot F to pivot A so that each segment 210, 220, and 230 is a channel having the "U" of the channel oriented outward and not toward the object 300 to be grasped when a flat grasping surface 226 is presented. This imparts considerable structural strength compared to arm cross-section when holding loads bearing down in the direction transverse to the plane of the arm and perpendicular to the plane of the paper of FIG. 13.

The grasping subassembly 200 moves with structurally triangular controllability instead of quadrilateral uncontrollability under the action of hydraulically extensible power cylinder 260 which is pivotally based to frame plate 270 at pivot G and has its push rod 265 pivotally connected to the inner arm intermediate ends 211 and 231 at the pivot D on triangular segment 220. In an advantageous aspect of the structure shown, the pivotal connection of the cylinder 260 at pivot D is identical in location with the pivotal connection of middle link 252 of linkage 250 at segment 220 of the inner arm. This connection considerably strengthens the inner arm due to the doubly triangular synergistic strength of triangle DCG composed of cylinder 260, middle link 252, and first link 251 and also triangle GDF composed of cylinder 260, inner arm segments 220 and 210, and frame plate 270. Thus, the inner arm is protected from bending and buckling at the important middle segment 220.

The grasping subassembly 220 is connected to a similar subassembly not shown by cross frame member 280 and together they grasp object 300 and hold it securely in the outer arm 240, inner arm 210,220,230, and against the throat forward surface of cross frame member 280.

Linkage 250 links 251, 252, and 253 are shown in FIG. 13 as three rigid bars 251,252, and 253 which provide structural simplicity as well as strength. However, it is within the scope of the invention that links 251, 252, and 253 are in some embodiments composite members. For example, each link can be replaced with structurally rigid elements of other shapes or be composed of triangles. Links 251 and 253 can also be any suitable lever assemblies such as ones composed of pivoted rigid bars which maintain the structurally triangular controllability of the entire grasping assembly 200 such that when the position of inner arm 210,220,230 is fixed, the position of outer arm 240 is also fixed.

It is to be understood, of course, that the invention comprehends numerous embodiments. Thus, in all cases the description of specific embodiments, structural alternatives, subcombinations, combinations, vehicles, articles, and devices herein are but illustrations of the broad scope of subject matter comprehended in the invention. The choices for specific designs may be made by persons skilled in the art for providing suitable embodiments adapted for the purposes at hand, by applying the principles disclosed herein so that the utility of the invention can be fully realized.

I claim:

1. A grasping arm subassembly article having frame plate means;

an inner arm member having first and second ends, said inner arm member being pivotally connected at the first end to said frame plate means; and an outer arm member having an inner end and an outer end, said outer arm member being pivotally connected between said inner and outer ends to the second end of said inner arm member;

characterized in that said grasping arm subassembly article further comprises:

linkage means comprising a first link, a middle link, and a second link, each of said links having a first end and a second end, said middle link first end being pivotally connected to said first link second end and said middle link second end being pivotally connected to said second link first end, said first link first end being pivotally connected to said frame plate means, said second link second end being pivotally connected to said inner end of said outer arm member, and said middle link being pivotally connected to said inner arm member between said first and second ends of said inner arm member and between said first and second ends of said middle link.

2. A grasping arm article as claimed in claim 1 wherein said arm further comprises extensible power means pivotally based on said frame means and pivotally connected to said inner arm between the first and second ends thereof.

3. A grasping arm article as claimed in claim 1 wherein said inner arm member has a surface for grasping an object inward relative to said grasping surface and said inner arm member has material for spacing said middle link away from the entire said grasping surface so that said linkage means lies entirely outward from said grasping surface and entirely outward from an imaginary straight line between said first and second ends of said inner arm member where said first and second ends are pivotally connected respectively to said frame plate means and said outer arm member.

4. A grasping arm article as claimed in claim 3 wherein said arm further comprises extensible power means pivotally based on said frame means and pivotally connected to said inner arm member at the same place where said middle link is pivotally connected to said inner arm member.

5. A grasping arm article as claimed in claim 3 wherein said spacing material is channel-shaped, said middle link is capable of turning inside said channel-shaped material, and said first and second links have respective lengths such that said linkage means causes said outer arm member to move graspingly in response to motion of said inner arm member.

6. A grasping arm article as claimed in claim 5 wherein said inner arm member has a channel-shaped cross-section along its entire length.

7. A grasping device article comprising a plurality of grasping arm subassembly articles each being as claimed in claim 1; and boom means, said grasping arm subassembly articles being attached to said boom means at said frame plate means.

8. A grasping device comprising in combination a frame, extensible power means, and a plurality of arm members connected to said frame, at least one of said arm members comprising an inner arm having first and second ends, said inner arm being pivoted at the first end in said connection to said frame;

an outer arm having an inner end and an outer end, said outer arm being pivoted intermediate said inner and outer ends to the second end of said inner arm; and linking means comprising a first link, a middle link, and a second link, each of said links having first and second ends, said middle link first end being pivoted to said first link second end and said middle link second end being pivoted to said second link first end, said first link first end being pivoted to said frame and said second link second end being pivoted to said inner end of said outer arm, said middle link being pivoted to said inner arm intermediate said first and second ends of said inner arm and intermediate said first and second ends of said middle link, said grasping device having said extensible power means pivoted to said at least one said arm member and pivoted to said grasping device so as to move said at least one said arm member graspingly relative to the rest of said plurality of arm members.

9. A grasping device as claimed in claim 8 wherein said extensible power means comprises a first cylinder and a second cylinder; and said plurality of arm members includes a second arm member comprising:

a second inner arm having first and second ends, said second inner arm being pivoted at the first end in said connection to said frame;

a second outer arm having an inner end and an outer end, said second outer arm being pivoted intermediate said inner and outer ends to the second end of said second inner arm; and second linking means comprising a first link, a middle link, and a second link, each of said links having first and second ends, said middle link first end being pivoted to said first link second end and said middle link second end being pivoted to said second link first end, said first link first end being pivoted to said frame and said second link second end being pivoted to said inner end of said second outer arm, said middle link of said second linking means being pivoted to said second inner arm intermediate said first and second ends of said second inner arm and intermediate said first and second ends of said middle link of said second linking means, said first cylinder being pivoted to said at least one said arm member and pivoted to said grasping device, said second cylinder being pivoted to said second arm member and pivoted to said grasping device so as to move said second arm member graspingly relative to said at least one said arm member.

10. A grasping device as claimed in claim 8 wherein said grasping device further comprises powered boom means attached to said frame for controllably moving said frame.

11. A grasping device as claimed in claim 10, said grasping device further comprising:

a vehicle capable of self-locomotion having a chassis; and hydraulic control means for use by a human operator;

said powered boom means and said extensible power means being connected to said hydraulic control means and operable therefrom, and said powered boom means being pivotally mounted to said chassis.

12. A grasping device comprising a frame;

a pair of diverging inner arms, each of which has an inner end and an outer end, each of said inner ends being pivotally mounted to said frame for movement about a first axis respectively;

a pair of outer arms, each of which has an inner end and an outer end, each said outer arm being pivotally connected intermediate said inner and outer end thereof to said outer end of each of said inner arms for movement about a second axis respectively;

a pair of extensible power means each of which interconnects said frame and one of said inner arms respectively for causing said movement of said inner arms; and a pair of linkage mechanisms each pivotally interconnecting said frame, one of said inner arms and one of said outer arms for causing said movement of each said outer arm in response to said movement of each said inner arm respectively.

13. A grasping device as claimed in claim 12 wherein each said linkage mechanism comprises first, second and third links, said first link having one end pivotally connected to said frame and an opposite end pivotally connected to said second link, said third link having one end pivotally connected to the respective outer arm and an opposite end pivotally connected to said second link, said second link being pivotally connected to the respective inner arm.

14. A grasping device as claimed in claim 12 wherein said grasping device further comprises a longitudinally extensible boom assembly having at least two boom members telescopically mounted with respect to one another; and boom power means connected to said boom members for causing said telescopic extensible assembly to move longitudinally, said frame being mounted on one end of one of said boom members.

15. A grasping device as claimed in claim 14 wherein said grasping device further comprises a base frame pivotally connected to the other end of the other of said boom members; and second boom power means pivotally connected to said base frame and the other of said boom members for causing movement of said boom assembly relative to said base frame pivotally.

16. A grasping device as claimed in claim 15 wherein said grasping device further comprises third boom power means pivotally connected to said one end of said one of said boom members and to said frame having said arms, said frame being mounted so as to be able to move pivotally with respect to said one end of said one of said boom members.

17. A grasping device as claimed in claim 16 wherein said grasping device further comprises means for causing said third boom power means to maintain a level orientation of said arms during pivotal movement of said boom assembly relative to said base frame.

18. A refuse collection vehicle comprising cab-and-chassis means for self-locomotion and load support;

refuse bin means mounted and supported on said chassis;

first frame means side-mounted to and supported by said chassis beneath said bin means;

boom means comprising first, second, and third hydraulic extension means, an inner boom and an outer boom telescopically mounted and movable with respect to each other by said first hydraulic extension means, said inner boom being pivotally connected to said first frame, said second hydraulic extension means being pivotally connected to said inner boom and said first frame for moving said boom means between a lateral and an upstanding position;

grasping means comprising second frame means and first and second arm members, each of said first and second arm members respectively comprising an inner arm member having first and second ends, each said inner arm member being pivotally connected at the first end to said second frame, an outer arm member having an inner end and an outer end, each said outer arm member being pivotally connected intermediate said inner and outer ends to the respective second end of each said inner arm member, linkage means comprising a first link, a middle link, and a second link, each of said links having first and second ends, said middle link first end being pivotally connected to said first link second end and said middle link second end being pivotally connected to said second link first end, said first link first end of each said linkage means being pivotally connected to said second frame and said second link second end of each said linkage means being pivotally connected to the respective inner end of each said outer arm member, and each said middle link being pivotally connected to each said inner arm respectively intermediate said first and second ends of said inner arm and intermediate said first and second ends of said middle link, said grasping means further comprising fourth and fifth hydraulic extension means each being pivotally based on said second frame and pivotally connected to said first and second arm members respectively so as to move said arm members graspingly relative to one another;

said second frame being pivotally connected to said outer boom, said third hydraulic extension means being connected to said outer boom and said second frame so as to make said grasping device movable at said second frame relative to said outer boom;

slave hydraulic leveling cylinder means pivotally connected to said inner boom and said first frame and hydraulically interconnected with said third hydraulic extension means for keeping said grasping means levelled when said boom is moved between its lateral and upstanding positions; and hydraulic control panel and control circuit means hydraulically interconnected with said first, second, third, fourth, and fifth hydraulic extension means for controllably operating said boom means and grasping means so as to extend said boom, grasp a container, lift, dump, lower, and release said container, and retract said boom in a refuse collection operation under control of a human operator at said control panel of said refuse collection vehicle.

* * * * *